United States Patent [19]

Kamimura

[11] 4,057,004

[45] Nov. 8, 1977

[54] FAIL-SAFE FLUID CONTROL VALVE

[75] Inventor: Toshio Kamimura, Gifu, Japan

[73] Assignee: Teijin Seiki Company Limited, Osaka, Japan

[21] Appl. No.: 707,762

[22] Filed: July 22, 1976

[30] Foreign Application Priority Data

July 25, 1975 Japan ..... 50-91320

[51] Int. Cl.[2] ..... F15B 13/04; F15B 20/00

[52] U.S. Cl. ..... 91/30; 91/31; 91/448; 137/596

[58] Field of Search ..... 91/30, 31, 448; 137/596; 251/232

[56] References Cited

U.S. PATENT DOCUMENTS

| | | | |
|---|---|---|---|
| 3,253,613 | 5/1966 | Richolt | 137/596 |
| 3,439,707 | 4/1969 | York et al. | 137/596 |
| 3,933,176 | 1/1976 | Wheeler | 137/596 |

*Primary Examiner*—Alan Cohan
*Assistant Examiner*—Gerald A. Michalsky
*Attorney, Agent, or Firm*—Cushman, Darby & Cushman

[57] ABSTRACT

A fail-safe fluid control valve including a first sleeve accommodated in and fixed to a valve housing, a second valve also accommodated in and fixed to the valve housing in parallel relation with the first sleeve, a first valve spool slidably accommodated in the first sleeve, and a second valve spool slidably accommodated in the second sleeve. The first and second sleeves are properly formed with grooves and ports while the first and second valve spools are properly formed with large diameter portions spaced. When there occurs such an abnormal condition that the first valve spool and the first sleeve are jammed or stuck to each other, the second valve spool is adapted to be moved for actuating the fail-safe control valve under entirely the same condition as a normal condition.

3 Claims, 6 Drawing Figures

FAIL-SAFE FLUID CONTROL VALVE

This invention relates to a fail-safe fluid control valve for use in aircrafts and the like, and more particularly to a control valve including two valve means one of which can be normally operated even if the other is under abnormal conditions such as accidents and stoppage thereof.

It is generally a common practice to use a fail-safe fluid control valve in mechanical systems required for high reliability such as for example aircraft flight control systems for their movable wings. Conventionally, there have been provided a variety of such fail-safe fluid control valves one type of which is provided with a pair of sleeves slidably accommodating therein and engaged with respective valve spools so as to move one of the valve spools in a normal condition while to move the other valve spool in an abnormal condition where the one of the valve spools is jammed or stuck to the corresponding sleeve upon control for the control valve of its type. However, it is found that all the conventional control valves of the type lack reliability and are complicated in construction.

On the other hand, there is liable to occur a hydrolock phenomenon where the other valve spool is stuck to the corresponding sleeve in the normal condition where it is kept stationary.

It is therefore a primary object of the present invention to provide a fail-safe control valve which can satisfactorily operate its control valve cylinder even under an abnormal condition.

It is another object of the present invention to provide a fail-safe fluid control valve which has high reliability and is simple in construction.

It is a further object of the present invention to provide a fail-safe fluid control valve which overcomes such a hydrolock phenomenon where the other valve spool is stuck to the corresponding sleeve in the normal condition.

In order to accomplish the foregoing objects, one embodiment of a fail-safe fluid control valve in accordance with the present invention comprises: a valve housing having first and second concave portions formed therein in parallel relation with each other, a first sleeve positioned within and fixed to the first concave portion of the valve housing, the first sleeve including first, second and third port groups located at a predetermined interval along its axial direction and each having one or more radial ports circumferentially equi-angularly formed in the first sleeve, a first orifice group located between the first and second port groups and having one or more radial orifices circumferentially equi-angularly formed in the first sleeve, a second orifice group located between the second and third port groups and having one or more radial orifices circumferentially equi-angularly formed in the first sleeve, a first annular groove formed on the outer periphery of the first sleeve in fluid communication with the ports of the first port group, a second annular groove formed on the outer periphery of the first sleeve in fluid communication with the orifices of the first orifice group, a third annular groove formed on the outer periphery of the first sleeve in fluid communication with the ports of the second port group, a fourth annular groove formed on the outer periphery of the first sleeve in fluid communication with the orifices of the second orifice group, a fifth annular groove formed on the outer periphery of the first sleeve in fluid communication with the ports of the third port group; a first valve spool reciprocably accommodated in the first sleeve and having first, second, third and fourth large diameter portions integrally formed on the outer periphery of the first valve spool, the interval between the second and third large diameter portions being substantially equal to the interval between the first and second orifice groups, the axial length of each of the second and third large diameter portions being substantially equal to the axial length of each of the orifices of the first and second orifice groups, and the first and fourth large diameter portions being located at all times axially outwardly of the first and third port groups; a second sleeve positioned within and fixed to the second concave portion of the valve housing, the second sleeve including fourth, fifth, sixth and seventh port groups located at a predetermined interval along its axial direction and each having one or more radial ports circumferentially equi-angularly formed in the second valve spool, a third orifice group located between the fourth and fifth port groups and having one or more radial orifices circumferentially equi-angularly formed in the second sleeve, a sixth orifice group located between the sixth and seventh port groups and having one or more radial orifices circumferentially equi-angularly formed in the second sleeve, fourth and fifth orifice groups positioned in side-by-side relation between the fifth and sixth port groups and each having one or more radial orifices circumferentially equi-angularly formed in the second sleeve, seventh and eighth orifice groups positioned in side-by-side relation axially outwardly of the seventh port group and each having one or more radial orifices circumferentially equi-angularly formed in the second sleeve, a sixth annular groove formed on the outer periphery of the second sleeve in fluid communication with the ports of the fourth port group, a seventh annular groove formed on the outer periphery of the second sleeve in fluid communication with the orifices of the third orifice group, an eighth annular groove formed on the outer periphery of the second sleeve in fluid communication with the ports of the fifth port group, a ninth annular groove formed on the outer periphery of the second sleeve in fluid communication with the orifices of the fourth orifice group, and eleventh annular groove formed on the outer periphery of the second sleeve in fluid communication with the orifices of the sixth orifice group, a thirteenth annular groove formed on the outer periphery of the second sleeve in fluid communication with the orifices of the eighth orifice group, a tenth annular groove formed on the outer periphery of the second sleeve in fluid communication with the orifices of the fifth orifice group and the ports of the sixth port group, and a twelveth annular groove formed on the outer periphery of the second sleeve in fluid communication with the ports of the seventh port group and the orifices of the seventh orifice group; a second valve spool reciprocably accommodated in the second sleeve and having fifth, sixth, seventh, eighth, ninth, tenth and eleventh large diameter portions, the interval between the sixth and ninth large diameter being substantially equal to the interval between the third and sixth orifice groups, the axial length of each of the sixth and ninth large diameter portions being substantially equal to the axial length of each of the orifices of the third and sixth orifice groups, the end face of the eighth large diameter portion facing the seventh large diameter portion being brought into substantial alignment with the inner face of each of the orifices of the fifth orifice group adjacent to the sixth port group and the end face of the tenth large diameter portion facing the eleventh large diameter portion being brought into substantial alignment with the inner face of the orifices of the seventh orifice group adjacent to the seventh port group when the orifices of the third and sixth orifice groups come to be in opposing relation with and closed by the sixth and ninth large diameter portions, respectively, the end face of the seventh large diameter portion facing the eighth large diameter portion being brought into substantial alignment with the inner face of each of the orifices of the fourth orifice group adjacent to the fifth port group when the orifices of the third and sixth orifice groups come to be in opposing relation with and closed by the sixth and ninth large diameter portions, respectively, the axial length of the seventh large diameter portion being substantially equal to the axial length of each of the orifices of the fourth orifice group, the end face of the eleventh diameter portion facing the tenth large diameter portion being brought into substantial alignment with the axially outermost inner face of each of the eighth orifice group when the orifices of the third and sixth orifice groups come to be in opposing relation with and closed by the sixth and ninth large diameter portions, respectively, the axial length of the eleventh large diameter portion being larger than the axial length of each of the orifices of the eighth orifice group, and the fifth large diameter portion being at all times positioned axially outwardly of the fourth port group, a first passage formed in the valve housing to communicate the second and seventh annular grooves; a second passage formed in the valve housing to communicate the third and ninth annular grooves; a third passage formed in the valve housing to communicate the fourth and eleventh annular grooves; a fourth passage formed in the valve housing to communicate the first, fifth and thirteenth annular grooves; a fifth passage formed in the valve housing to communicate the sixth and twelveth annular grooves; a valve cylinder having a pair of cylinder conduits communicated with the second and fourth annular grooves, respectively; an inlet conduit communicated with the eighth and tenth annular grooves; an outlet conduit communicated with the twelveth annular groove; and a reciprocating input mechanism disposed in the vicinity of and operably connected to the first and second valve spools so that only the first valve spool is reciprocated with the second valve spool held stationary to reciprocate any one of the valve housing and a piston rod of the valve cylinder in a normal condition while the second valve spool is reciprocated for imparting a reciprocating motion to any one of the valve housing and the piston rod of the valve cylinder in an abnormal condition where the first valve spool is stuck to the first sleeve to prevent the first valve spool from being reciprocated in the first sleeve.

The other embodiment of a fail-safe fluid control valve in accordance with the present invention comprises: a valve housing having first and second concave portions formed therein in parallel relation with each other, a first sleeve positioned within and fixed to the first concave portion of the valve housing, a second sleeve positioned within and fixed to the second concave portion of the valve housing, a first valve spool reciprocably accommodated in the first sleeve, a second valve spool reciprocably accommodated in the second sleeve, a valve cylinder operatively connected to the valve housing and having a reciprocable piston rod, whereby the first valve spool is reciprocated in the first sleeve for reciprocation motion of any one of the valve housing and the piston rod of the valve cylinder in a normal condition while the second valve spool is reciprocated in the second sleeve for reciprocation motion of any one of the valve housing and the piston rod of the valve cylinder in an abnormal condition where the first valve spool is stuck to the first sleeve and thus unable to be reciprocated in the first sleeve; the improvement comprising in combination: a first lever provided adjacent the end portions of the first and second valve spools; a second lever having an upper end pivotally connected to the end portion of the second valve spool and a lower end pivotally connected to the end portion of the first valve spool; a rockable rod provided adjacent the second valve spool and securely connected to the first lever in perpendicular relation with the first lever and the second valve spool for imparting a rocking motion to the first lever; a pivotal pin pivotally connecting the intermediate portions of the first and second levers for allowing the first and second lever to be pivotable; a projection integrally connected to the end of the first valve spool through an annular ledge interposed therebetween and extending in axial alignment with the first valve spool; a movable annular collar axially slidably retained on the projection; a fixed annular collar securely retained on the free end of the projection; a first compression coil spring positioned between the movable annular collar and the fixed annular collar to surround the projection; a cylindrical member pivotally connected to the lower end of the first lever and retained in slidable relation with the first valve spool to surround the projection; a fixed annular member securely retained on the inner periphery of the free end of the cylindrical member; and a second compression coil spring positioned between the movable annular collar and the fixed annular members to surround the first compression coil spring.

The features and advantages of the fail-safe fluid control valve according to the present invention will become more apparent from the following description taken in conjunction with the accompanying drawings, in which.

Figure 1:
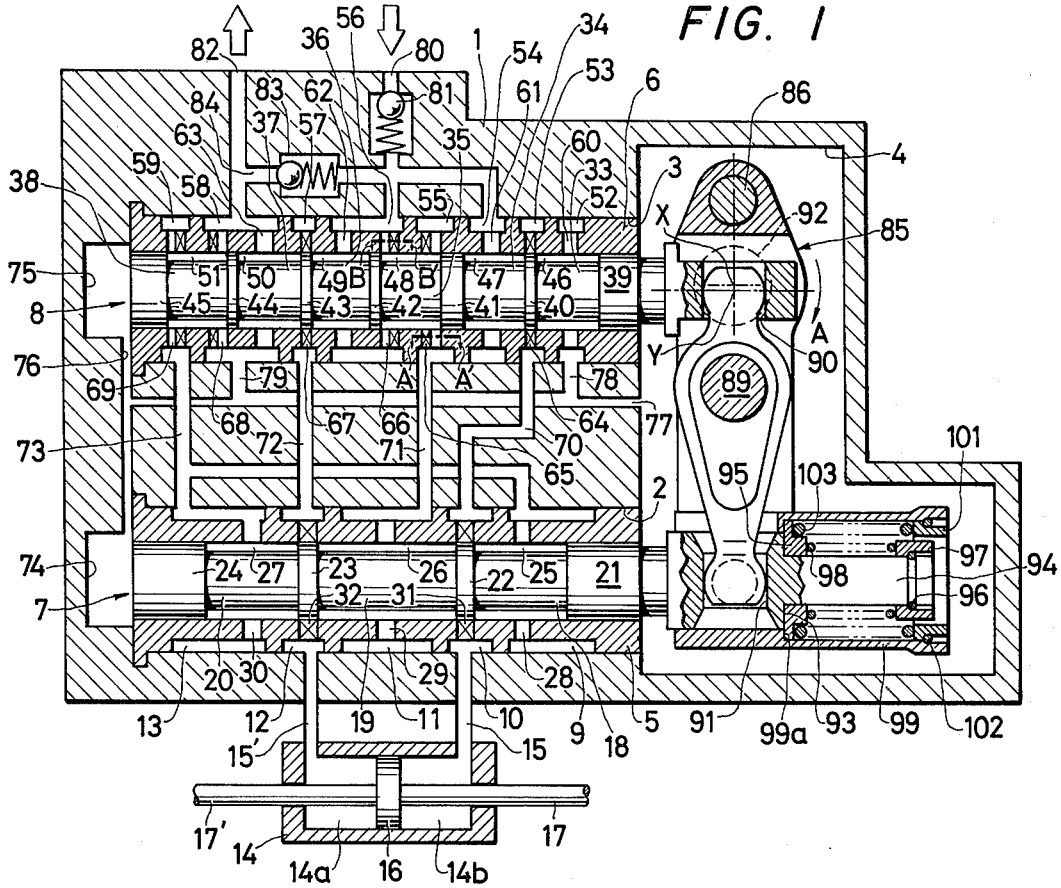
FIG. 1 is a cross-sectional view of a preferred embodiment of the fail-safe fluid control valve according to the present invention and showing a null position in a normal condition thereof.
Figure 5:
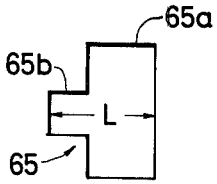
FIG. 5 is a cross-sectional view as seen from the line A–A′ in FIG. 1.
Figure 6:
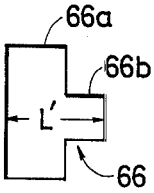
FIG. 6 is a cross-sectional view as seen from the line B–B′ in FIG. 1.

Referring now to the drawings and in particular to FIG. 1, the reference numeral 1 designates a valve housing which has a first concave portion 2 and a second concave portion 3 formed therein in parallel relation with each other. A chamber 4 is formed in the valve housing 1 at the ends of the first and second concave portions 2 and 3 in connecting relation therewith. A first sleeve 5 is positioned within and fixed to the first concave portion 2, while a second sleeve 6 is similarly positioned within and fixed to the second concave portion 3. A first valve spool 7 is slidably accommodated in the first sleeve 5 and a second valve spool 8 is likewise slidably housed in the second sleeve 6. The first sleeve 5 is provided on its periphery with first, second, third, fourth and fifth annular grooves 9, 10, 11, 12 and 13 which are arranged from its one end adjacent the chamber 4 to its other end remote from the chamber 4, the first, third and fifth annular grooves 9, 11 and 13 being each adapted to be made wider in its axial direction than each of the second and fourth annular grooves 10 and 12. A fluid-operated valve cylinder 14 is positioned in the vicinity of the valve housing 1 and has a pair of cylinder conduits 15 and 15' which are in fliud communication with the second and fourth annular grooves 10 and 12, respectively. Within the valve cylinder 14 is slidably accommodated a piston 16 which has both faces securely connected with piston rods 17 and 17'. The first spool 7 is formed on its outer periphery with small diameter portions 18, 19, 20 and large diameter portions 21, 22, 23, 24 so as to define a chamber 25 surrounded by the small diameter portion 18, the large diameter portions 21, 22 and the inner periphery of the first sleeve 5, a chamber 26 surrounded by the small diameter portion 19, the large diameter portions 22, 23 and the inner periphery of the first sleeve 5, and a chamber 27 surrounded by the small diameter portion 20, the large diameter portions 23, 24 and the inner periphery of the first sleeve 5. First, second and third port groups 28, 29 and 30 are positioned at a predetermined interval along its axial direction and each of the first, second and third port groups 28, 29 and 30 consists of one or more radial bores or ports circumferentially equi-angularly formed in the first sleeve 5 so that the ports of the first port group 28 communicates the first annular groove 9 with the chamber 25, the ports of the second port group 29 communicates the third annular groove 11 with the chamber 26, and the ports of the third port group 30 communicates the fifth annular groove 13 with the chamber 27. A first orifice group 31 consists of one or more radial bores or orifices circumferentially equi-angularly formed in the first sleeve 5 which orifices are designed to communicate the second annular groove 10 and the inner wall of the first sleeve 5. The orifices of the first orifice group 31 are shown in FIG. 1 as closed by the large diameter portion 22 which has an axial length substantially equal to the axial length of each of the orifices of the first orifice group 31. A second orifice group 32 likewise consists of one or more radial bores or orifices circumferentially equi-angularly formed in the first sleeve 5 which orifices are designed to communicate the fourth annular groove 12 and the inner wall of the first sleeve 5. The orifices of the second orifice group 32 are also shown in FIG. 1 as closed by the large diameter portion 23 which has also an axial length substantially equal to the axial length of each of the orifices of the second orifice group 32. The interval spaced between the second and third large diameter portions 22 and 23 is adapted to be substantially equal to the interval spaced between the first and second orifice groups 31 and 32, while the first and fourth large diameter portions 21 and 24 are positioned at all times axially outwardly of the first and third port groups 28 and 30, respectively. The second spool 8 is formed on its outer periphery with small diameter portions 33, 34, 35, 36, 37, 38 and large diameter portions 39, 40, 41, 42, 43, 44, 45 so as to define a chamber 46 surrounded by the small diameter portion 33, the large diameter portions 39, 40 and the inner periphery of the second sleeve 6, a chamber 47 surrounded by the small diameter portion 34, the large diameter portions 40, 41 and the inner periphery of the second sleeve 6, a chamber 48 surrounded by the small diameter portion 35, the large diameter portions 41, 42 and the inner periphery of the second sleeve 6, a chamber 49 surrounded by the small diameter portion 36, the large diameter portions 42, 43 and the inner periphery of the second sleeve 6, a chamber 50 surrounded by the small diameter portions 37, the large diameter portions 43, 44 and the inner periphery of the second sleeve 6, and a chamber 51 surrounded by the small diameter portion 38, the large diamter portions 44, 45 and the inner periphery of the second sleeve 6. The second sleeve 6 is provided on its periphery with the sixth, seventh, eighth, ninth, tenth, eleventh, twelveth and thirteenth annular grooves 52, 53, 54, 55, 56, 57, 58 and 59 which are arranged from its one end adjacent the chamber 4 to its other end remote from the chamber 4, the tenth and twelveth annular grooves 56 and 58 being adapted to be made wider than each of the sixth, seventh, eighth, ninth, eleventh and thirteenth annular grooves 52, 53, 54, 55, 57 and 59. Fourth, fifth, sixth and seventh port groups 60, 61, 62 and 63 are positioned at a predetermined interval along its axial direction and each of the fourth, fifth, sixth and seventh port groups 60, 61, 62 and 63 consists of one or more radial bores or ports circumferentially equi-angularly formed in the second sleeve 6 so that the ports of the fourth port group 60 communicate the sixth annular groove 52 and the chamber 46, the ports of the fifth port group 61 communicate the eighth annular groove 54 and the chamber 47, the ports of the sixth port group 62 communicate the tenth annular groove 56 and the chamber 49, nd the ports of the seventh port group 63 communicate the twelveth annular groove 58 and the chamber 50. A third orifice group 64 consists of one or more radial bores or orifices circumferentially equi-angularly formed in the second sleeve 6 between the fourth and fifth port groups 60 and 61, which orifices are designed to communicate the seventh annular groove 53 and the inner wall of the second sleeve 6. The orifices of the third orifice group 64 are shown in FIG. 1 as closed by the large diameter portion 40 which has an axial length substantially equal to the axial length of each of orifices of the third orifice group 64. Fourth and fifth orifice groups 65 and 66 are positioned in side-by-side relation between the fifth and sixth port groups 61 and 62 and each consists of one or more radial bores or orifices circumferentially equi-angularly formed in the second sleeve 6 in such a manner that the orifices of the fourth orifice group 65 communicates the ninth annular groove 55 and the chamber 48 while the orifices of the fifth orifice group 66 communicates the tenth annular groove 56 and the chamber 48. A sixth orifice group 67 is positioned in the sleeve 6 between the sixth port group 62 and the seventh port group 63 and consists of one or more radial bores or orifices circumferentially equi-angularly formed in the second sleeve 6 in such a manner that the orifices of the sixth orifice group 67 communicates the eleventh annular groove 57 with the inner wall of the second sleeve 6. The orifices of the sixth orifice group 67 are shown in FIG. 1 as closed by the large diameter portion 43 which has an axial length substantially equal to the axial length of each of the orifices of the sixth orifice group 67. Seventh and eighth orifice groups 68 and 69 are positioned in the second sleeve 6 axially outwardly of the seventh port group 63 in side-by-side relation with each other and each consists of one or more bores or orifices circumferentially equi-angularly formed in the second sleeve 6 in such a manner that the orifices of the seventh orifice group 68 communicate the twelveth annular groove 58 and the chamber 51 while the orifices of the eighth orifice group 69 communicate the thirteenth annular groove 59 and the chamber 51. The interval spaced between the sixth and ninth large diameter portions 40 and 43 is adapted to be substantially equal to the interval spaced between the third and sixth orifice groups 64 and 67, while the axial length of each of the sixth and ninth large diameter portions 40 and 43 is made substantially equal to the axial length of each of the orifices of the third and sixth orifice groups 64 and 67. When the orifices of the third and sixth orifice groups 64 and 67 are brought into opposing relation with and closed by the sixth and ninth large diameter portions 40 and 43 as shown in FIG. 1, the end face of the eighth large diameter portion 42 facing the seventh large diameter portion 41 comes to be in substantial alignment with the inner face of each of the orifices of the fifth orifice group 66 adjacent to the sixth port group 62 while the end face of the tenth large diameter portion 44 facing the eleventh large diameter portion 45 becomes in substantial alignment with the inner face of each of the orifices of the seventh orifice group 68 adjacent to the seventh port group 63. Under the state as shown in FIG. 1, the end face of the seventh large diameter portion 41 facing the eighth large diameter portion 42 is brought into substantial alignment with the inner face of each of the orifices of the fourth orifice group 65 adjacent to the fifth port group 61. On the other hand, the axial length of the large diameter portion 41 is designed to be substantially equal to the axial length of each of the orifices of the fourth orifice group 65. Under the state as shown in FIG. 1, the end face of the eleventh large diameter portion 45 facing the tenth large diameter portion 44 is brought into substantial alignment with the axially outermost inner face of each of the orifices of the eighth orifice group 69. The axial length of the eleventh large diameter portion 45 is adapted to be larger than the axial length of each of the orifices of the eighth orifice group 69, while the fifth large diameter portion 39 is positioned at all times at a place axially outwardly of the fourth port group 60. The axial length of the eighth large diameter portion 42 is substantially equal to the half of the axial length of each of the orifices of the fifth orifice group 66, and the axial length of the tenth large diameter portion 44 is made substantially equal to the half of the axial length of each of the orifices of the seventh orifice group 68. As shown in FIG. 5, each of the orifices of the fourth orifice group 65 consists of a large sectioned rectangular orifice portion **65*a* and a small sectioned square orifice portion 65*b* in contact with the rectangular orifice portion 65*a*, wherein the foregoing axial length of each of the orifices of the fourth group 65 is intended to indicate a maximum length L in an axial direction. Each of the orifices of the seventh orifices 68 is adapted to have a cross-sectioned configuration substantially equal to each of the orifices of the fourth orifice group 65. As also shown in FIG. 6, each of the orifices of the fifth orifice group 66 consists of a large sectioned rectangular orifice portion 66*a* and a small sectioned square orifice portion 66*b* in contact with the rectangular orifice portion 66*a* but opposite to the previously mentioned square orifice portion 65*b*, wherein the foregoing axial length of each of the orifices of the fifth orifice group 66 is similarly intended to indicate a maximum length L′ in an axial direction. Each of the orifices of the eighth orifice group 69 is adapted to have a cross-sectioned configuration substantially equal to each of the orifices of the fifth orifice group 66. A passage 70 is formed in the valve housing 1 to communicate the second annular groove 10 with the seventh annular groove 53. A passage 71 is also formed in the valve housing 1 to communicate the third annular groove 11 with ninth annular groove 55. A passage 72 is also formed in the valve housing 1 to communicate the fourth annular groove 12 with eleventh annular groove 57. A passage 73 is also formed furcately from the thirteenth annular groove 59 in the valve housing 1 to communicate the first annular groove 9 and the fifth annular groove 13. In opposite relation with the left sides of the first and second spools 7 and 8 are respectively formed in the valve housing 1 a pair of chambers 74 and 75 which are fluidally communicated to each other by means of a passage 76 which is also formed in the valve housing 1. The passage 76 and the chamber 4 is communicated by a passage 77 which is formed in the valve housing 1 to be communicated with the sixth and twelveth annular groove 52 and 58 through passages 78 and 79, respectively. An inlet conduit 80 is formed in the valve housing 1 to be communicated through a check valve 81 with the eighth and tenth annular grooves 54 and 56, while an outlet conduit 82 is also formed in the valve housing 1 to be communicated with the twelveth annular groove 58. The eighth annular groove 54 is adapted to be in communication with the inlet conduit 80 and concurrently with the outlet conduit 82 through a passage 84 formed in the valve housing 1 and having therein a check valve 83.**

Figure 4:
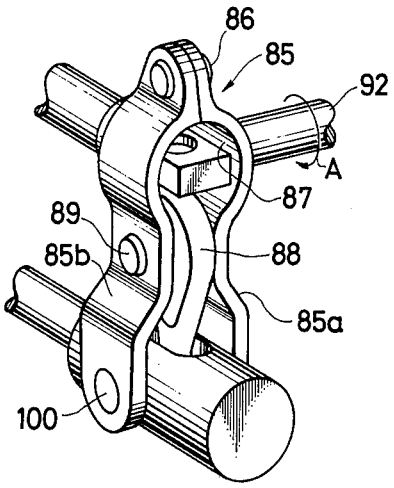
FIG. 4 is a perspective view of first and second levers of an input mechanism for respectively reciprocating the first valve spool and a second valve spool within the first sleeve and a second sleeve.

A first lever generally designated at 85 is provided in the chamber 4 adjacent the end portions of the first and second valve spools 7 and 8 and comprises two members **85*a* and 85*b* which have respective upper ends connected together by means of a pin member 86 as best shown in FIG. 4. The first lever 85 is formed with a cylindrical portion 87 collectively defined by the members 85*a* and 85*b* arcuately curved at their upper portions. A second lever 88 is pivotally connected at its intermediate portion immediately below the cylindrical portion 87 to the first lever 85 by means of a pivotal pin 89. The second lever 88 has an upper end in the form of a substantially spherical shape and engaged with a bore 90 formed in the end of the second valve spool 8 projected into the chamber 4. The lower end of the second lever 88 is likewise formed in a substantially spherical shape and is engaged with a bore 91 formed in the end of the first valve spool 7 projected into the chamber 4. A rockable rod 92 is securely connected at its one end to the outer wall of the cylindrical portion 87 of the first lever 85 in perpendicular relation to the first lever 85 and the second valve spool 8. The connected position of the rockable rod 92, i.e., the pivotal point X of the rockable rod 92 is adapted to be separated by a small length from the pivotal center point Y of the end of the second valve spool 8 and the second lever 88. The right end of the first valve spool 7 projected into the chamber 4 is integrally connected with a projection 94 extending in axial alignment with the first valve spool 7 through an annular ledge 93 interposed therebetween. A movable annular collar 95 is axially slidably retained on the projection 94. On the free end of the projection 94 is securely retained a fixed annular collar 97 by an annular ring 96. A first compression coil spring 98 is positioned between the movable annular collar 95 and the fixed annular collar 97 to surround the projection 94. A cylindrical member 99 is interposed between the members 85***a* and 85*b* of the first lever 85 and is pivotally retained by pivotal pins 100 to surround the first compression spring 98, the movable annular collar 95, the fixed annular collar 97 and the projection 94 in slidable relation with the right end portion of the first valve spool 7. A fixed annular member 101 is securely retained on the inner periphery of the free end of the cylindrical member 99 by means of an annular ring 102. A second compression coil spring 103 is positioned between the movable annular collar 95 and the fixed annular member 101 to surround the first compression coil spring 98. The cylindrical member 99 is formed on its inner periphery with an annular ledge 99*a* to be engageable with the movable collar 95.

The operation of the fail-safe control valve of the present invention thus constructed and arranged will now be described with reference to FIGS. 1 to 4.

FIG. 1 shows a null position of the fail-safe control valve embodying the present invention with the first lever 85 held in a substantially vertical direction. In this state, the orifices of the first and second orifice groups 31 and 32 are respectively held closed by the large diameter portions 22 and 23 of the first valve spool 7. The piston 16 and the piston rods 17 and 17' are thus held under a condition as shown in FIG. 1 since a pressure oil fed into the chamber 26 is not fed to and discharged from either cylinder conduits 15 or 15'. When the piston 16 and the piston rods 17 and 17' are then required to be moved rightwardly, the first valve spool 7 is caused to move leftwardly. At this time, the orifices of the first and second orifice group 31 and 32 are opened so that the pressure oil in the chamber 26 is introduced into the left chamber 14*a* of the valve cylinder 14 through the orifices of the second orifice group 32, the fourth annular groove 12 and the cylinder conduit 15' while the pressure oil in the right chamber 14*b* of the valve cylinder 14 is discharged therefrom and introduced into the chamber 25 through the cylinder conduit 15, the second annular groove 10 and the orifices of the first orifice group 31, thereby causing the piston 16 and the piston rods 17 and 17'to be moved rightwardly. The pressure oil in the chamber 26 is fed from a suitable pressure oil source not shown through the inlet conduit 80, the tenth annular groove 56, the orifices of the fifth orifice group 66, the chamber 48, the orifices of the fourth orifice group 65, the passage 71, the third annular groove 11 and the ports of the second port group 29. On the other hand, the pressure oil in the chamber 25 is discharged from the outlet conduits 82 through the ports of the first port group 28, the first annular groove 9, the passage 73, the thirteenth annular groove 59, the orifices of the eighth orifice group 69, the chamber 51, the orifices of the seventh orifice group 68 and the twelveth annular groove 58. When the piston 16 and the piston rods 17 and 17' are rightwardly moved, the first valve spool 7 is returned to the original state as shown in FIG. 1 by means of a suitable known feedback mechanism which is not shown in the drawings so that the piston 16 and piston rods 17 and 17' are prevented from excessively running. When the piston 16 and the piston 17 and 17' are then required to be moved leftwardly, the first valve spool 7 is moved rightwardly. At this time, the pressure oil in the chamber 26 is introduced into the right chamber 14*b* of the valve cylinder 14 through the orifices of the first orifice group 31, the second annular groove 10 and the cylinder conduit 15 while the pressure oil in the left chamber 14*b* of the valve cylinder 14 is discharged therefrom and fed to the chamber 27 through the cylinder conduit 15', the fourth annular groove 12 and the orifices of the second orifice group 32, thereby causing the piston 16 and the piston rods 17 and 17' to be moved leftwardly. Although the pressure oil in the chamber 26 is fed thereto through the previously mentioned path, the pressure oil in the chamber 27 is discharged from the outlet passage 82 through the ports of the third port group 30, the fifth annular groove 13, the passage 73 and the previously mentioned path. When the piston 16 and the piston rods 17 and 17' are moved leftwardly, the first valve spool 7 is similarly returned to the original state as shown in FIG. 1 by means of the afore-mentioned feedback mechanism so that the piston 16 and the piston rods 17 and 17' are prevented from excessively running. The operation of leftwardly moving the first valve spool 7 is carried out by rotating the rockable rod 92 toward an arrow A shown in FIGS. 1 and 4. At this time, the lower end of the first lever 85 is moved leftwardly in FIG. 1 so that the first valve spool 7 is moved leftwardly through the second compression coil spring 103 and the movable annular collar 95. Additionally the pivotal pin 89, the first valve spool 7 and the second valve spool 8 is rotated around the pivotal point X of the rockable rod 92 jointly with the first lever 85. On the other hand, the operation of rightwardly moving the first valve spool 7 is carried out by rotating the rockable rod 92 in an opposite direction to the arrow A shown in FIGS. 1 and 4. At this time, the lower end of the first lever 85 is moved rightwardly in FIG. 1 so that the first valve spool 7 is moved rightwardly through the first compression coil spring 98 and the fixed annular collar 97 while the movable annular collar 95 is being urged by the annular ledge 99*a* of the cylindrical member 99. The second lever 88 is at this time rotated around the rockable rod 92.

There have been described normal operations in which the first valve spool 7 and the first sleeve 5 are not jammed or stuck to each other, however, abnormal operations will be described hereinafter in such a condition that the normal operations are expected to be obtained due to the jamming between the first valve spool 7 and the first sleeve 5.

Figure 2:
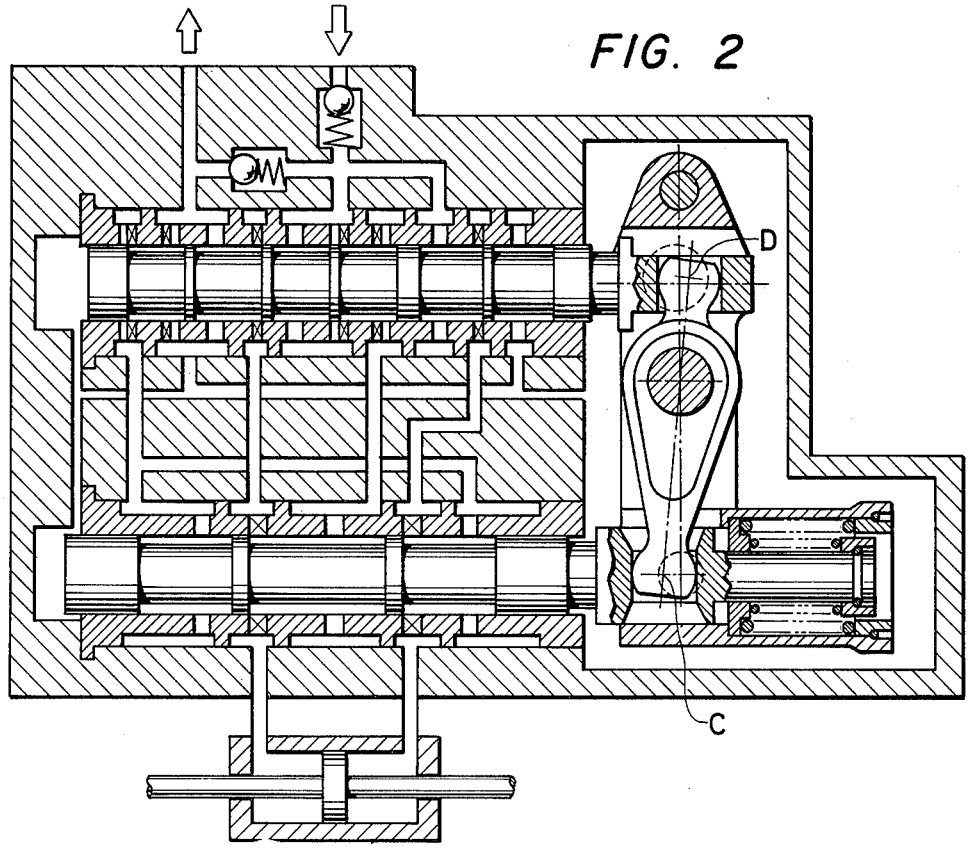
FIG. 2 is a cross-sectional view similar to FIG. 1 but showing a null position in an abnormal condition thereof where a first valve spool is jammed or stuck to a first sleeve after it is leftwardly moved.

FIG. 2 illustrates a condition in which the control valve of the present invention can not normally be operated since the first valve spool 7 is jammed or stuck to the first sleeve 5 when it is moved leftwardly. At this time, the second valve spool 8 is in turn rightwardly by means of the feedback mechanism due to the jamming of the first sleeve 5 and the first valve spool 7 so that the cylinder conduits 15 and 15'respectively communicated with left and right chambers 14*a* and 14*b* of the valve cylinder 14 are brought into communication with each other thereby to cause the oil pressure in the chambers 14*a* and 14*b* to be balanced. Thus, the piston 16 and the piston rods 17 and 17' are stopped into a null condition as illustrated in FIG. 2.

In order to leftwardly move the piston 16 and the piston rods 17 and 17' from the state shown in FIG. 2, the second valve spool 8 is required to be rightwardly moved from that state until the orifices of the fifth orifice group 66 are communicated with the tenth annular groove 56 and the chamber 48 are closed by the eighth large diameter portion 42. Thus, the feed of the pressure oil to the passage 71 is stopped and the orifices of the eighth orifice group 69 are closed by the eleventh large diameter portion 45 so that the discharge of the pressure oil from the passage 73 is stopped, thereby causing the piston 16 and the piston rods 17 and 17' to be moved leftwardly.

When the piston 16 and the piston rods 17 and 17' are moved leftwardly, the second valve spool 8 is moved leftwardly by the action of the feedback mechanism so that the eighth and eleventh large diameter portions 42 and 45 respectively open the orifices of the fifth and eighth orifice groups 66 and 69 to bring the cylinder conduits 15 and 15' of the valve cylinder 14 into communication. The oil pressure of the chambers **14*a* and 14*b* thus becomes balanced and the null position of the control valve takes place as shown in FIg. 2 with the result that the piston 16 and the piston rods 17 and 17'** are stopped.

In order to rightwardly move the piston 16 and the piston rods 17 and 17', the second valve spool 8 is required to be leftwardly moved from the state shown in FIG. 2 until the orifices of the third orifice group 64 are closed by the sixth large diameter portion 40. Thus, the feed of the pressure oil to the passage 70 is stopped and the orifices of the sixth orifice group 67 are closed by the ninth large diameter portion 43 so that the discharge of the pressure oil from the passage 72 is stopped, thereby causing the pressure oil to be introduced in the left chamber **14*a* of the valve cylinder 14 through the orifices of the second orifice group 32. On the other hand, the pressure oil in the right chamber 14*b* of the valve cylinder 14 is discharged through the orifices of the first orifice group 31 so that the piston 16 and the piston rods 17 and 17'are rightwardly moved. When the piston 16 and the piston rods 17 and 17' are moved rightwardly, the second valve spool 8 is rightwardly moved by the action of the feedback mechanism so that the sixth and ninth large diameter portions 40 and 43 respectively open the orifices of the third and sixth orifice groups 64 and 67 to bring the cylinder conduits 15 and 15' of the valve cylinder 14 into communication. The oil pressure of the chambers 14*a* and 14*b* thus becomes balanced and the null position of the control valve occurs as shown in FIG. 2 so that the piston 16 and the piston rods 17 and 17' are stopped. Under the state in which the first valve spool 7 is held moved leftwardly as shown in FIG. 2, the operation of rightwardly moving the second valve spool 8 is performed by rotating the rockable rod 92 in an opposite direction to the arrow A. At this time, the lower point C of the second lever 88 is not moved but the lower portion of the first lever 85 and the pivotal pin 89 are further moved rightwardly from the positions shown in FIG. 2. The movable annular collar 95 is thus brought into engagement with the ledge 99*a* of the cylindrical member 99 to compress the first compression coil spring 98. When the cylindrical member 99 and the pivotal pin 89 are moved rightwardly and the lower point C of the second lever 88 is not moved, the upper point D of the second lever 88 is rotated in the clockwise direction around the lower point C of the second lever 88. The relative rotation of the second lever 88 and the first lever 85 is performed by way of the pivotal pin 89. On the other hand, the operation of leftwardly moving the second valve spool 8 in a state where the first valve spool 7 is leftwardly moved as shown in FIG. 2 is carried out by rotating the rockable rod 92 in the arrow direction A to leftwardly move the first lever 85 and the pivotal pin 89.**

There will be hereinafter described in FIG. 3 about the state that the first valve spool 7 is rightwardly moved and stuck to the first sleeve 5.

Figure 3:
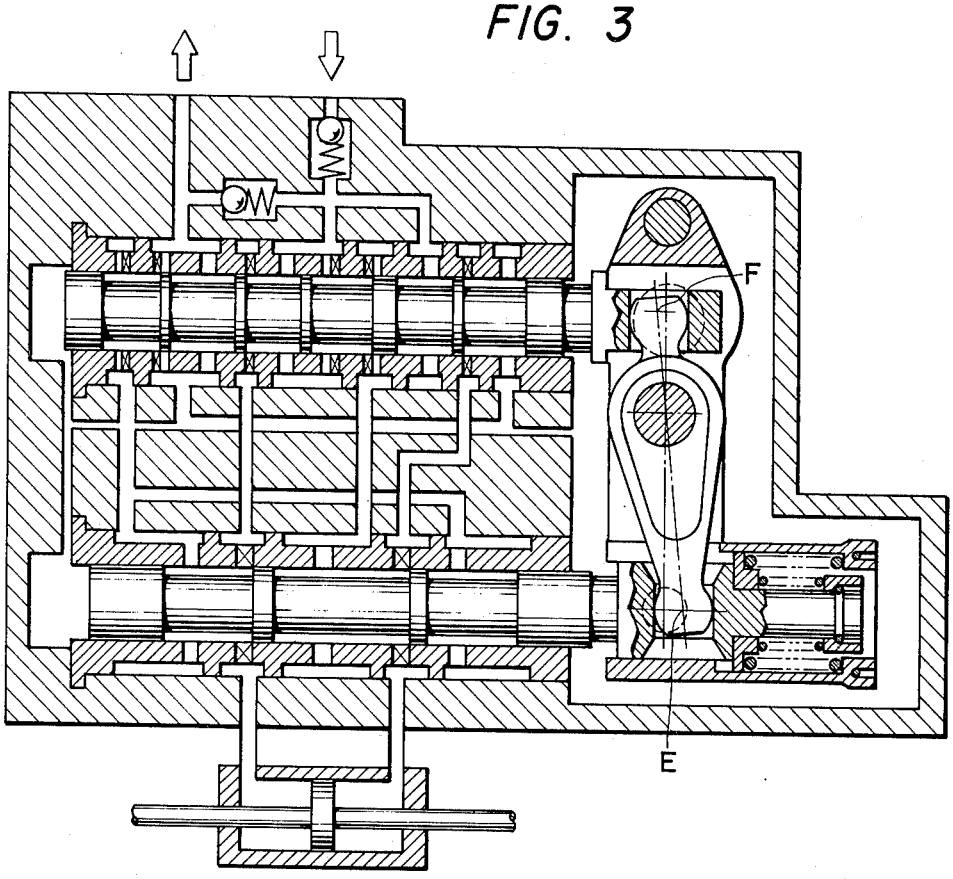
FIG. 3 is a cross-sectional view similar to FIG. 1 but showing a null position in another abnormal condition thereof where a first valve spool is jammed or stuck to a first sleeve after it is rightwardly moved.

In order to leftwardly move the piston 16 and the piston rods 17 and 17' from the state just mentioned, the second valve spool 8 is required to be moved rightwardly from the condition shown in FIG. 3 until the large diameter portions 40 and 43 close the orifices of the third and sixth orifice groups 64 and 67, respectively. At this time, the pressure oil fed from the passage 80 is introduced into the right chamber **14*b* of the valve cylinder 14 through the tenth annular groove 56, the orifices of the fifth orifice group 66, the chamber 48, the orifices of the fourth orifice group 65, the ninth annular groove 55, the passage 71, the third annular groove 11, the ports of the second port group 29, the chamber 26, the orifices of the first orifice group 31, the second annular groove 10 and the cylinder conduit 15, while the pressure oil in the left chamber 14*a* of the valve cylinder 14 is discharged from the outlet conduit 82 through the cylinder conduit 15', the fourth annular groove 12, the orifices of the second orifice group 32, the chamber 27, the ports of the third port group 30, the fifth annular groove 13 and the passage 73, so that the piston 16 and the piston rods 17 and 17' are leftwardly moved. When the piston 16 and the piston rods 17 and 17' are leftwardly moved, the second valve spool 8 is leftwardly moved by the action of the feedback mechanism to be brought into the null position, thereby resulting in preventing the piston 16 and the piston rods 17 and 17' from excessively running. The null position takes place when the left and right chambers 14*a* and 14*b* of the valve cylinder 14 are mutually communicated by the cylinder conduits 15 and 15', balancing the oil pressure of the chambers 14*a* and 14*b*. When the piston 16 and the piston rods 17 and 17' are required to be moved rightwardly, the second valve spool 8 is moved leftwardly from the condition shown in FIG. 3 until the large diameter portion 41 closes the orifices of the fourth orifice group 65 and the large diameter portion 44 assumes a position leftward of the seventh orifice group 68. At this time, the pressure oil fed from the inlet passage 80 is introduced into the left chamber 14*a* of the valve cylinder 14 through the tenth annular groove 56, the ports of the sixth port 62, the chamber 49, the orifices of the sixth orifice group 67, the eleventh annular groove 57, the passage 72, the fourth annular groove 12 and the cylinder conduit 15', while the pressure oil in the right chamber 14*b* of the valve cylinder 14 is discharged from the outlet conduit 82 through the cylinder conduit 15, the second annular groove 10, the passage 70, the seventh annular groove 53, the orifices of the third orifice group 64, the chamber 46, the ports of the fourth port group 60, the sixth annular groove 52, the passage 78, 77, 79 and the twelveth annular groove 58, so that the piston 16 and the piston rods 17 and 17' are moved rightwardly. When the piston 16 and the piston rods 17 and 17' are moved rightwardly, the second valve spool 8 is moved rightwardly by the action of the feedback mechanism to be brought into the null position in FIG. 3, thereby resulting in preventing the piston 16 and the piston rods 17 and 17' from excessively running. In the state where the first valve spool 7 is rightwardly moved in FIG. 3, the operation of rightwardly moving the second valve spool 8 is carried out by rotation of the rockable rod 92 in an opposite direction to the arrow A, whereupon the lower point E of the second lever 88 is not moved but the lower portion of the first lever 85 and the pivotal pin 89 are moved rightwardly from the position shown in FIG. 3. When the cylindrical member 99 and the pivotal pin 89 is rightwardly moved and the lower point E of the second lever 88 is not moved, the upper point F of the second lever 88 is caused to be rightwardly moved. At this time, the relative rotation of the second lever 88 and the first lever 85 is performed through the pivotal pin 89** in a similar manner to the foregoing description.

On the other hand, in the state where the first valve spool 7 is rightwardly moved in FIG. 3, the operation of leftwardly moving the second valve spool 8 is carried out by the rockable rod 92 in the direction of the arrow A to leftwardly move the first lever 85 and the pivotal pin 89.

Since the pivotal point X of the rockable rod 92 is separated by a small length from the pivotal center point Y of the second lever 88 and the second valve spool 8 as shown in FIG. 1, the second valve spool 8 does a small axial reciprocation motion within the second sleeve 6 in the normal condition where the first valve spool 7 is not jammed or stuck to the first valve sleeve 5. More specifically, the second spool 8 slides leftwardly and rightwardly in a small stroke since the pivotal center point Y is slightly rotated in the clockwise and anticlockwise directions around the pivotal point X upon leftward and rightward movement of the first valve spool 7 caused by the first lever 85. As a result, the second valve spool 8 is by no means stuck to the second sleeve 6, which makes it possible to control or operate the control valve of the present invention in a similar fashion to the normal condition in the abnormal event that the first valve spool 7 and the first sleeve 5 are mutually stuck or jammed. It is therefore to be noted that the hydro-lock phenomenon can be avoided.

While there has been described about the fact that the piston rods 17 and 17' of the valve cylinder 14 are reciprocated with the valve housing 1 kept stationary, the valve housing 1 may be reciprocated with the piston rods 17 and 17' kept stationary according to the present invention.

It is to be understood that the fail-safe control valve of the present invention is not only of high reliability but also simple in construction.

Although particular embodiments of the present invention have been shown and described, it will be obvious to those skilled in the art that various changes and modifications may be made without departing from the spirit and scope of the present invention.

What is claimed is:

1. A fail-safe fluid control valve comprising:

a valve housing having first and second concave portions formed therein parallel relation with each other, a first sleeve positioned within and fixed to said first concave portion of said valve housing, said first sleeve including first, second and third port groups located at a predetermined interval along its axial direction and each having one or more radial ports circumferentially equi-angularly formed in said first sleeve, a first orifice group located between said first and second port groups and having one or more radial orifices circumferentially equi-angularly formed in said first sleeve, a second orifice group located between said second and third port groups and having one or more radial orifices circumferentially equi-angularly formed in said first sleeve, a first annular groove formed on the outer periphery of said first sleeve in fluid communication with said ports of said first port group, a second annular groove formed on the outer periphery of said first sleeve in fluid communication with said orifices of said first orifice group, a third annular groove formed on the outer periphery of said first sleeve in fluid communication with said ports of said second port group, a fourth annular groove formed on the outer periphery of said first sleeve in fluid communication with said orifices of said second orifice group, a fifth annular groove formed on the outer periphery of said first sleeve in fluid communication with said ports of said third port group;

a first valve spool reciprocably accommodated in said first sleeve and having first, second, third and fourth large diameter portions integrally formed on the outer periphery of said first valve spool, the interval between said second and third large diameter portions being substantially equal to the interval between said first and second orifice groups, the axial length of each of said second and third large diameter portions being substantially equal to the axial length of each of said orifices of said first and second orifice groups, and said first and fourth large diameter portions being located at all times axially outwardly of said first and third port groups;

a second sleeve positioned within and fixed to said second concave portion of said valve housing, said second sleeve including fourth, fifth, sixth and seventh port groups located at a predetermined interval along its axial direction and each having one or more radial ports circumferentially equi-angularly formed in said second valve spool, a third orifice group located between said fourth and fifth port groups and having one or more radial orifices circumferentially equi-angularly formed in said second sleeve, a sixth orifice group located between said sixth and seventh port groups and having one or more radial orifices circumferentially equi-angularly formed in said second sleeve, fourth and fifth orifice groups positioned in side-by-side relation between said fifth and sixth port groups and each having one or more radial orifices circumferentially equi-angularly formed in said second sleeve, seventh and eighth orifice groups positioned in side-by-side relation axially outwardly of said seventh port group and each having one or more radial orifices circumferentially equi-angularly formed in said second sleeve, a sixth annular groove formed on the outer periphery of said second sleeve in fluidal communication with said ports of said fourth port group, a seventh annular groove formed on the outer periphery of said second sleeve in fluidal communication with said orifices of said third orifice group, and eighth annular groove formed on the outer periphery of said second sleeve in fluidal communication with said ports of said fifth port group, a ninth annular groove formed on the outer periphery of said second sleeve in fluidal communication with said orifices of said fourth orifice group, an eleventh annular groove formed on the outer periphery of said second sleeve in fluidal communication with said orifices of said sixth orifice group, a thirteenth annular groove formed on the outer periphery of said second sleeve in fluidal communication with said orifices of said eighth orifice group, a tenth annular groove formed on the outer periphery of said second sleeve in fluidal communication with said orifices of said fifth orifice group and said ports of said sixth port group, and a twelveth annular groove formed on the outer periphery of said second sleeve in fluidal communication with said ports of said seventh port group and said orifices of said seventh orifice group;

a second valve spool reciprocably accommodated in said second sleeve and having fifth, sixth, seventh, eighth, ninth, tenth and eleventh large diameter portions, the interval between said sixth and ninth large diameter being substantially equal to the interval between said third and sixth orifice groups, the axial length of each of said sixth and ninth large diameter portions being substantially equal to the axial length of each of said orifices of said third and sixth orifice groups, the end face of said eighth large diameter portion facing said seventh large diameter portion being brought into substantial alignment with the inner face of each of said orifices of said fifth orifice group adjacent to said sixth port group and the end face of said tenth large diameter portion facing said eleventh large diameter portion being brought into substantial alignment with the inner face of each of said orifices of said seventh orifice group adjacent to said seventh port group when said orifices of said third and sixth orifice groups come to be in opposing relation with and closed by said sixth and ninth large diameter portions, respectively, the end face of said seventh large diameter portion facing said eighth large diameter portion being brought into substantial alignment with the inner face of each of said orifices of said fourth orifice group adjacent to said fifth port group when said orifices of said third and sixth orifice groups come to be in opposing relation with and closed by said sixth and ninth large diameter portions, respectively, the axial length of said seventh large diameter portion being substantially equal to the axial length of each of said orifices of said fourth orifice group, the end face of said eleventh diameter portion facing said tenth large diameter portion being brought into substantial alignment with the axially outermost inner face of each of said eighth orifice group when said orifices of said third and sixth orifice groups come to be in opposing relation with and closed by said sixth and ninth large diameter portions, respectively, the axial length of said eleventh large diameter portion being larger than the axial length of each of said orifices of said eighth orifice group, and said fifth large diameter portion being at all times positioned axially outwardly of said fourth port group, a first passage formed in said valve housing to communicate said second and seventh annular grooves;

a second passage formed in said valve housing to communicate said third and ninth annular grooves;

a third passage formed in said valve housing to communicate said fourth and eleventh annular grooves;

a fourth passage formed in said valve housing to communicate said first, fifth and thirteenth annular grooves;

a fifth passage formed in said valve housing to communicate said sixth and twelveth annular grooves;

a valve cylinder having a pair of cylinder conduits communicated with said second and fourth annular grooves, respectively;

an inlet conduit communicated with said eighth and tenth annular grooves;

an outlet conduit communicated with said twelveth annular groove; and a reciprocating input mechanism disposed in the vicinity of and operably connected to said first and second valve spools so that only said first valve spool is reciprocated with said second valve spool held stationary to reciprocate any one of said valve housing and a piston rod of said valve cylinder in a normal condition while said second valve spool is reciprocated for imparting a reciprocating motion to any one of said valve housing and said piston rod of said valve cylinder in an abnormal condition where said first valve spool is stuck to said first sleeve to prevent said first valve spool from being reciprocated in said first sleeve.

2. A fail-safe fluid control valve comprising: a valve housing having first and second concave portions formed therein in parallel relation with each other, a first sleeve positioned within and fixed to said first concave portion of said valve housing, a second sleeve positioned within and fixed to said second concave portion of said valve housing, a first valve spool reciprocably accommodated in said first sleeve, a second valve spool reciprocably accommodated in said second sleeve, a valve cylinder operatively connected to said valve housing and having a reciprocable piston rod, whereby said first valve spool is reciprocated in said first sleeve for reciprocation motion of any one of said valve housing and said piston rod of said valve cylinder in a normal condition while said second valve spool is reciprocated in said second sleeve for reciprocation motion of any one of said valve housing and said piston rod of said valve cylinder in an abnormal condition where said first valve spool is stuck to said first sleeve and thus unable to be reciprocated in said first sleeve; the improvement comprising in combination:

a first lever provided adjacent the end portions of said first and second valve spools;

a second lever having an upper end pivotally connected to the end portion of said second valve spool and a lower end pivotally connected to the end portion of said first valve spool;

a rockable rod provided adjacent said second valve spool and securely connected to said first lever in perpendicular relation with said first lever and said second valve spool for imparting a rocking motion to said first lever;

a pivotal pin pivotally connecting the intermediate portion of said first and second levers for allowing said first and second lever to be pivotable;

a projection integrally connected to the end of said first valve spool through an annular ledge interposed therebetween and extending in axial alignment with said first valve spool;

a movable annular collar axially slidably retained on said projection;

a fixed annular collar securely retained on the free end of said projection;

a first compression coil spring positioned between said movable annular collar and said fixed annular collar to surround said projection;

a cylindrical member pivotally connected to the lower end of said first lever and retained in slidable relation with the first valve spool to surround said projection;

a fixed annular member securely retained on the inner periphery of the free end of said cylindrical member; and a second compression coil spring positioned between said movable annular collar and said fixed annular member to surround said first compression coil spring.

3. A fail-safe fluid control valve as defined in claim 2, in which the pivotal center point of the end of the second valve spool and the upper end of the second lever is separated by a small length from the pivotal point of the first lever and the rockable rod.

* * * * *